US005867923A

United States Patent [19]

Lehneis

[11] Patent Number: 5,867,923

[45] Date of Patent: Feb. 9, 1999

[54] ORTHOTIC SHOE WITH TORSION SOLE

[76] Inventor: Hans Richard Lehneis, 39A Grammacy Park North, Suite 1A, New York, N.Y. 10010

[21] Appl. No.: 890,028

[22] Filed: Jan. 16, 1997

Related U.S. Application Data

[60] Provisional application No. 60/010,062 Jan. 16, 1996.

[51] Int. Cl. [6] ..... A43B 13/12

[52] U.S. Cl. ..... 36/25 R; 36/103; 36/142

[58] Field of Search ..... 36/25 R, 28, 1, 36/103, 116, 140, 142, 143, 144, 126, 128

[56] References Cited

U.S. PATENT DOCUMENTS

| | | | |
|---|---|---|---|
| 2,269,815 | 1/1942 | Goodman . | |
| 3,354,561 | 11/1967 | Cameron | 36/126 |
| 3,424,166 | 1/1969 | Gibbons . | |
| 3,470,879 | 10/1969 | Meiller . | |
| 5,224,810 | 7/1993 | Pitkin | 36/25 R |
| 5,566,478 | 10/1996 | Forrester | 36/126 |

*Primary Examiner*—M. D. Patterson
*Attorney, Agent, or Firm*—Darby & Darby

[57] ABSTRACT

A sole for a shoe is discosed which is constructed with a relatively rigid top layer or insole and a relatively rigid bottom layer or outsole which are mounted for relative rotation about an axis perpendicular to and extending through the center of the sole. Between the insole and outsole, there is provided a relatively yieldable elastomer layer, which permits relative rotation between the insole and the outsole upon rotation of the foot during walking, but will resiliently restore the insole and outsole to an aligned position when the torsional force of the foot is removed.

10 Claims, 1 Drawing Sheet

ORTHOTIC SHOE WITH TORSION SOLE

FIELD OF THE INVENTION

The present invention relates generally to orthotic shoes and, more particularly concerns a torsion sole construction which reduces abrasive contact between the insole of a shoe and the plantar surface of the wearer's foot.

BACKGROUND OF THE INVENTION

Diabetics lack sensation in the plantar or bottom surface of the foot and, typically, have a reduced amount of fatty tissue at that location. Accordingly, they are particularly susceptible to skin irritation and breakdown occasioned by frictional contact between the plantar surface of the foot and the insole of the shoe. This frictional contact results from torsion between the foot and pelvis, which causes transverse foot rotation during the normal walking motion. Such rotation results in shear stresses between the plantar surface of the foot and the surface with which it comes in contact (the insole of the shoe or the floor). Since diabetics lack sensation in the foot and are more susceptible to irritation, it is not uncommon for them to develop plantar ulceration.

It is therefore an object of the present invention to provide an orthotic shoe which will substantially reduce or eliminate abrasive contact between the plantar surface of the foot and the insole of a shoe occasioned by transverse rotation of the foot during normal walking. It is specifically contemplated that the invention would provide a sole construction in which the transverse rotation of the foot would be absorbed by the shoe sole.

It is another object of the invention to provide an orthotic shoe and sole construction to substantially reduce or eliminate abrasive contact between the plantar surface of the foot and a shoe insole, which are reliable and convenient in use, yet relatively simple and inexpensive in construction.

In accordance with the present invention, a shoe sole is constructed with a relatively rigid top layer or insole and a relatively rigid bottom layer or outsole which are mounted for relative rotation about an axis perpendicular to and extending through the center of the sole. Between the insole and outsole, there is provided a relatively yieldable elastomer layer, which permits relative rotation between the insole and the outsole upon rotation of the foot during walking, but resiliently restores the insole and outsole to an aligned position when the torsional force of the foot is removed.

BRIEF DESCRIPTION OF THE DRAWING

The foregoing, as well as other objects, features and advantages of the present invention will be understood more completely from the following detailed description of a presently preferred, but nonetheless illustrative, embodiment of the invention, with reference being had to the accompanying drawing, in which.

DETAILED DESCRIPTION

Figure 1:
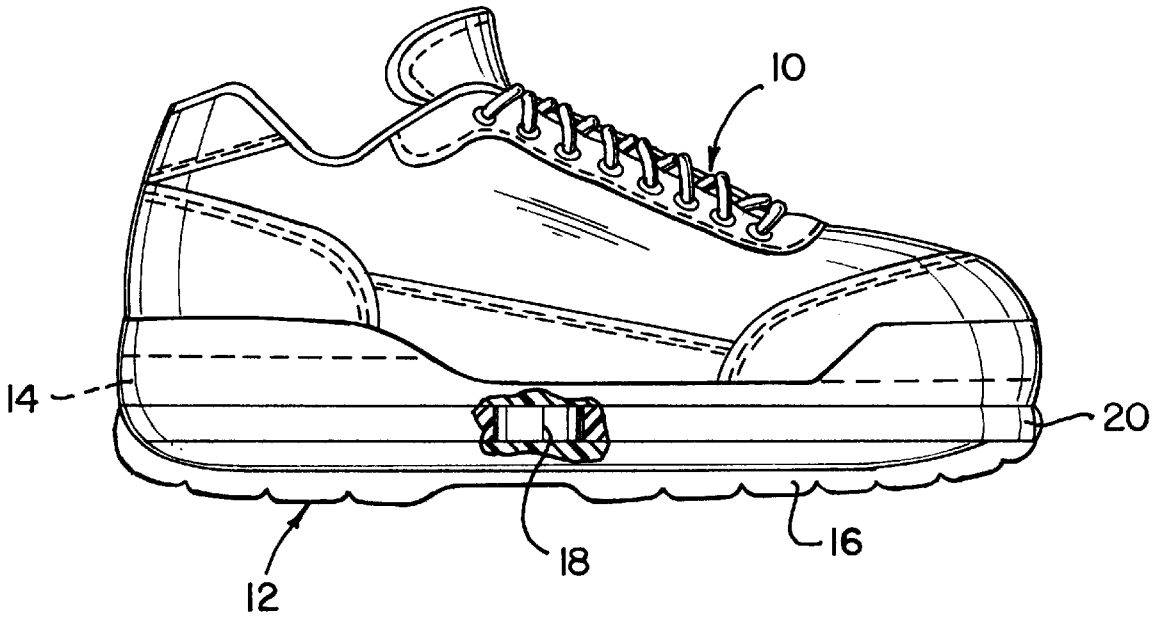
FIG. 1 is a side view of a shoe embodying the present invention, with parts shown in section.

Turning now to the drawing, there is disclosed an orthotic shoe 10 having a sole 12. The sole includes a semi-rigid top layer or insole 14 and a semi-rigid bottom layer or outsole 16, which may also include a bottom tread pattern made of, for example, rubber. Insole 14, and outsole 16 are mounted to a pivot 18 so as to submit relative rotation therebetween about an axis perpendicular to sole 12. Sandwiched between insole 14 and outsole 16, there is provided an elastomer layer 20, to which both the insole and the outsole are secured, as by bonding.

Figure 2:
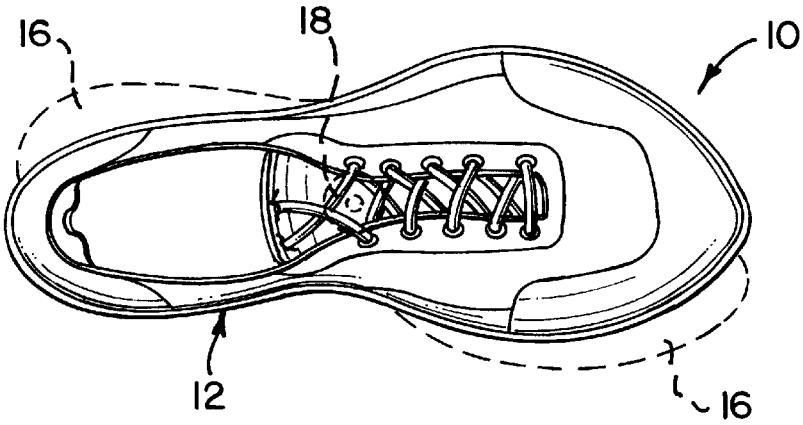
FIG. 2 is a top view of the shoe of FIG. 1 shown during the application of transverse rotation force by the foot.

In use, a elastomer 20 permits a degree of rotational movement between insole 14 and outsole 16. Thus, as shown in FIG. 2, during the stance phrase of walking, when the foot applies a transverse rotational moment to shoe 10, elastomer layer 20 yields, permitting relative rotation between insole 14 and outsole 16. After the toe-off phrase of walking, the rotational movement is removed from shoe 10, and the elastomer layer 20, through its resilience, causes insole 14 and outsole 16 to return into a relatively aligned position. Through this mode of operation, sole 12 avoids relative movement between the wearer's foot and insole 14, avoid abrasion of the plantar surface of the foot.

Pivot 18 is preferably made of hard rubber and is preferably positioned in the center of sole 12. By making pivot 18 of hard rubber and relatively rigid, it is possible to prevent translation between insole 14 and outsole 16, assuring stability of sole 12.

It is contemplated that sole 12 maybe integral to shoe 10, as illustrated or, alternatively, may replace the normal sole of any shoe or sneaker.

I claim:

1. A shoe sole comprising a relatively rigid top layer defining an insole and a relatively rigid bottom layer defining an outsole, pivot means defining an axis of rotation positioned substantially in the center of the shoe sole and perpendicular thereto, said layers being mounted together for relative rotation about said axis, a relatively yieldable elastomer layer formed between and joined to the insole and outsole, which permits relative rotation between the insole and the outsole upon rotation about said axis of the foot of a person wearing the shoe during walking, the yieldable elastomer layer, resiliently restoring the insole and outsole to an aligned position when the torsional force of the foot is removed.

2. A shoe sole in accordance with claim 1 further comprising a pivot member mounted to said insole and outsole so as to permit relative rotation therebetween.

3. A shoe having a sole in accordance with claim 2.

4. A shoe sole in accordance with claim 2 wherein said elastomer is adhered to said insole and outsole.

5. A shoe having a sole in accordance with claim 4.

6. A shoe having a sole in accordance with claim 1.

7. A shoe sole comprising a relatively rigid top layer defining an insole and a relatively rigid bottom layer defining an outsole a pivot member mounted to said insole and outsole so as to permit relative rotation therebetween, about an axis perpendicular to and extending through the sole, a relatively yieldable elastomer layer between and joined to the insole and outsole, which permits relative rotation between and joined to the insole and the outsole upon rotation about said axis of the foot of a person wearing the shoe during walking, the yieldable elastomer layer, resiliently restoring the insole and outsole to an aligned position when the torsional force of the foot is removed.

8. A shoe having a sole in accordance with claim 7.

9. A shoe sole in accordance with claim 7 wherein said elastomer is adhered to said insole and outsole.

10. A shoe having a sole in accordance with claim 9.

* * * * *

UNITED STATES PATENT AND TRADEMARK OFFICE

CERTIFICATE OF CORRECTION

PATENT NO. : 5,867,923

DATED : February 9, 1999

INVENTOR(S) : Lehneis

It is certified that error appears in the above-identified patent and that said Letters Patent is hereby corrected as shown below:

Column 1, line 2, please insert the following paragraph:
--The present application claims the priority under 35 U.S.C. § 119 of U.S. Provisional Patent Application No. 60/010,0625 filed January 16, 1996.--

Signed and Sealed this

Sixth Day of April, 1999

*Attest:*

Q. TODD DICKINSON

*Attesting Officer*

*Acting Commissioner of Patents and Trademarks*